US008525413B2

(12) United States Patent
Higashi

(10) Patent No.: US 8,525,413 B2
(45) Date of Patent: Sep. 3, 2013

(54) MAGNETRON FOR MICROWAVE OVEN

(75) Inventor: Masatoshi Higashi, Hokkaido (JP)

(73) Assignee: Toshiba Hokuto Electronics Corporation, Asahikawa-shi, Hokkaido (JP)

( * ) Notice: Subject to any disclaimer, the term of this patent is extended or adjusted under 35 U.S.C. 154(b) by 429 days.

(21) Appl. No.: 12/208,760

(22) Filed: Sep. 11, 2008

(65) Prior Publication Data

US 2009/0066252 A1 Mar. 12, 2009

(30) Foreign Application Priority Data

Sep. 11, 2007 (JP) ..... 2007-235511

(51) Int. Cl.
*H01J 25/50* (2006.01)

(52) U.S. Cl.
USPC ..... 315/39.51

(58) Field of Classification Search
USPC ..... 315/39.51, 39.65, 39.67, 7; 219/7
See application file for complete search history.

(56) References Cited

U.S. PATENT DOCUMENTS

| | | | | |
|---|---|---|---|---|
| 4,855,645 | A | 8/1989 | Kinuno et al. | |
| 5,635,797 | A * | 6/1997 | Kitakaze et al. | 315/39.51 |
| 5,635,798 | A | 6/1997 | Ogura et al. | |
| 5,798,613 | A * | 8/1998 | Lee | 315/39.51 |
| 5,861,716 | A * | 1/1999 | Ogura | 315/39.51 |
| 6,653,788 | B2 | 11/2003 | Ogura et al. | |
| 6,756,735 | B2 | 6/2004 | Lee et al. | |
| 6,844,680 | B2 | 1/2005 | Yoshihara et al. | |
| 6,960,283 | B2 * | 11/2005 | Lee et al. | 204/298.14 |
| 6,972,522 | B2 | 12/2005 | Yang | |
| 7,023,137 | B2 * | 4/2006 | Ishii et al. | 315/39.51 |
| 7,053,556 | B2 * | 5/2006 | Yoshihara et al. | 315/39.51 |
| 7,135,820 | B2 * | 11/2006 | Shon et al. | 315/39.51 |
| 7,235,929 | B2 * | 6/2007 | Inami | 315/39.51 |
| 2004/0140207 | A1 | 7/2004 | Lee et al. | |
| 2006/0219548 | A1 | 10/2006 | Baek et al. | |
| 2007/0296515 | A1 | 12/2007 | Kato et al. | |

FOREIGN PATENT DOCUMENTS

| | | | |
|---|---|---|---|
| EP | 0263491 | * | 10/1987 |
| EP | 0236491 | A2 * | 4/1988 |
| EP | 0263491 | A2 | 4/1988 |
| EP | 0327116 | * | 2/1989 |
| EP | 0327116 | A1 | 8/1989 |
| EP | 1562218 | A2 | 8/2005 |

(Continued)

OTHER PUBLICATIONS

EP 08 29 0823, European Search Report, Completion date Mar. 9, 2010.

(Continued)

*Primary Examiner* — Minh D A
(74) *Attorney, Agent, or Firm* — Banner & Witcoff, Ltd.

(57) ABSTRACT

A magnetron for microwave oven has an anode cylinder, vanes (height: H (mm)), a cathode spirally extending along the central axis, a pair of end hats (outer diameter: DEH1 (mm), DEH2 (mm)) fixed to both ends of the cathode, and a pair of pole pieces. Vanes extend from an inner surface of the anode cylinder to the central axis. Free ends of the vanes form a vane inscribing circle (diameter: Da (mm)). Pole pieces expand like funnels from through-holes (inner diameter: DPP1 (mm), DPP2 (mm)) facing to the end hats and pinch the cathode. The shape of the magnetron satisfies, H≦8.5, H/Da≦0.95, DEH1/DPP1≦0.8, DEH1/DPP2≦0.8, DEH2/DPP1≦0.8, DEH2/DPP2≦0.8, 0.92≦Da/DPP1≦0.95, and 0.92≦Da/DPP2≦0.95.

10 Claims, 3 Drawing Sheets

| number | height of vane (mm) H | diameter of vane inscribing circle(mm) Da | outer diameter of end hat(mm) output side DEH1 | outer diameter of end hat(mm) input side DEH2 | inner diameter of pole piece(mm) output side DPP1 | inner diameter of pole piece(mm) input side DPP2 |
|---|---|---|---|---|---|---|
| No.1 | 9.5 | 9.08 | 7.2 | 8.15 | 9.85 | 9.4 |
| No.2 | 9.5 | 9.08 | 7.2 | 8.15 | 9.4 | 9.4 |
| No.3 | 9.5 | 8.8 | 7.2 | 8.15 | 9.4 | 9.4 |
| No.4 | 8.5 | 9.08 | 7.2 | 8.15 | 9.4 | 9.4 |
| No.5 | 8.0 | 8.7 | 7.2 | 7.2 | 8.7 | 8.7 |
| No.6 | 8.0 | 8.7 | 7.2 | 7.2 | 9.0 | 9.5 |
| No.7 | 8.0 | 8.7 | 7.2 | 7.2 | 9.2 | 9.4 |

| number | H /Da | DEH1 /DPP1 | DEH1 /DPP2 | DEH2 /DPP1 | DEH2 /DPP2 | Da /DPP1 | Da /DPP2 |
|---|---|---|---|---|---|---|---|
| No.1 | 1.046 | 0.731 | 0.766 | 0.827 | 0.867 | 0.922 | 0.966 |
| No.2 | 1.046 | 0.766 | 0.766 | 0.867 | 0.867 | 0.965 | 0.966 |
| No.3 | 1.080 | 0.766 | 0.766 | 0.867 | 0.867 | 0.936 | 0.936 |
| No.4 | 0.936 | 0.766 | 0.766 | 0.867 | 0.867 | 0.966 | 0.966 |
| No.5 | 0.920 | 0.828 | 0.828 | 0.828 | 0.828 | 1.000 | 1.000 |
| No.6 | 0.920 | 0.800 | 0.758 | 0.800 | 0.758 | 0.967 | 0.916 |
| No.7 | 0.920 | 0.783 | 0.766 | 0.783 | 0.766 | 0.948 | 0.925 |

| number | cathode back heat (%) | load stability (A) | efficiency (%) | maximum anode voltage(kV) |
|---|---|---|---|---|
| No.1 | 92.0 | 1.97 | 71.0 | 4.15 |
| No.2 | 91.5 | 1.89 | 70.8 | 4.29 |
| No.3 | 91.2 | 2.14 | 71.3 | 4.14 |
| No.4 | 91.1 | 1.62 | 71.4 | 4.22 |
| No.5 | 96.5 | 1.74 | 71.9 | 4.45 |
| No.6 | 92.5 | 1.98 | 70.6 | 4.15 |
| No.7 | 90.5 | 1.93 | 71.3 | 4.31 |

(56) References Cited

FOREIGN PATENT DOCUMENTS

| | | | |
|---|---|---|---|
| EP | 1594152 | A2 | 11/2005 |
| JP | 02-030036 | A | 1/1990 |
| JP | 05-035531 | | 5/1993 |
| JP | 06223729 | | 8/1994 |
| JP | 07-302548 | | 11/1995 |
| JP | 08-167383 | | 6/1996 |
| JP | 61110527 | | 5/1998 |
| JP | 3329509 | B2 | 9/2002 |
| JP | 2002343262 | | 11/2002 |
| JP | 2003132809 | | 5/2006 |
| JP | 2006-260976 | | 9/2006 |
| JP | 2007-335351 | A | 12/2007 |

OTHER PUBLICATIONS

Office Action in JP 2006-168505, mailed Sep. 20, 2011.

"Vacuum Tubes," Karl R. Spangenberg, McGrawhill Book Company, Inc., 1948, pp. 660-663 and preface.

JP Notice of Reasons for Refusal received in corresponding JP Application 2007-235511, dated Jul. 23, 2009.

JP Notice of Reasons for Refusal received in corresponding JP Application 2007-235511, dated Oct. 13, 2009.

* cited by examiner

FIG.3

| number | height of vane (mm) H | diameter of vane inscribing circle(mm) Da | outer diameter of end hat(mm) | | inner diameter of pole piece(mm) | |
|---|---|---|---|---|---|---|
| | | | output side DEH1 | input side DEH2 | output side DPP1 | input side DPP2 |
| No.1 | 9.5 | 9.08 | 7.2 | 8.15 | 9.85 | 9.4 |
| No.2 | 9.5 | 9.08 | 7.2 | 8.15 | 9.4 | 9.4 |
| No.3 | 9.5 | 8.8 | 7.2 | 8.15 | 9.4 | 9.4 |
| No.4 | 8.5 | 9.08 | 7.2 | 8.15 | 9.4 | 9.4 |
| No.5 | 8.0 | 8.7 | 7.2 | 7.2 | 8.7 | 8.7 |
| No.6 | 8.0 | 8.7 | 7.2 | 7.2 | 9.0 | 9.5 |
| No.7 | 8.0 | 8.7 | 7.2 | 7.2 | 9.2 | 9.4 |

| number | H /Da | DEH1 /DPP1 | DEH1 /DPP2 | DEH2 /DPP1 | DEH2 /DPP2 | Da /DPP1 | Da /DPP2 |
|---|---|---|---|---|---|---|---|
| No.1 | 1.046 | 0.731 | 0.766 | 0.827 | 0.867 | 0.922 | 0.966 |
| No.2 | 1.046 | 0.766 | 0.766 | 0.867 | 0.867 | 0.966 | 0.966 |
| No.3 | 1.080 | 0.766 | 0.766 | 0.867 | 0.867 | 0.936 | 0.936 |
| No.4 | 0.936 | 0.766 | 0.766 | 0.867 | 0.867 | 0.966 | 0.966 |
| No.5 | 0.920 | 0.828 | 0.828 | 0.828 | 0.828 | 1.000 | 1.000 |
| No.6 | 0.920 | 0.800 | 0.758 | 0.800 | 0.758 | 0.967 | 0.916 |
| No.7 | 0.920 | 0.783 | 0.766 | 0.783 | 0.766 | 0.946 | 0.926 |

| number | cathode back heat (%) | load stability (A) | efficiency (%) | maximum anode voltage(kV) |
|---|---|---|---|---|
| No.1 | 92.0 | 1.97 | 71.0 | 4.15 |
| No.2 | 91.5 | 1.89 | 70.8 | 4.29 |
| No.3 | 91.2 | 2.14 | 71.3 | 4.14 |
| No.4 | 91.1 | 1.62 | 71.4 | 4.22 |
| No.5 | 86.5 | 1.74 | 71.9 | 4.45 |
| No.6 | 92.5 | 1.98 | 70.6 | 4.15 |
| No.7 | 90.5 | 1.93 | 71.3 | 4.31 |

MAGNETRON FOR MICROWAVE OVEN

CROSS REFERENCE TO RELATED APPLICATION

This application is based upon and claims the benefit of priority from the prior Japanese Patent Application No. 2007-235511 filed on Sep. 11, 2007; the entire content of which is incorporated herein by reference.

BACKGROUND OF THE INVENTION

The present invention relates to a magnetron for microwave oven.

An ordinary magnetron for microwave oven oscillating radio waves of 2450 MHz band is provided with an anode cylinder and a plurality of vanes. The vanes are radially arranged inside the anode cylinder. The vanes are alternately connected together in the direction of circumference by a pair of large and small strap rings soldered with the top and bottom ends of the vanes. A spiral cathode is located along the axis of the anode cylinder in the electronic interaction space surrounded by the free ends of the vanes. Both ends of the spiral cathode are fixed to the output side end hat and the input side end hat respectively. Furthermore, both ends of the anode cylinder are fixed to pole pieces formed like funnels of output and input side respectively.

In view of miniaturization of heating appliances per se, resource saving and cost reduction, it is required to miniaturize the magnetron for microwave oven. However, merely miniaturization would cause degradation of various characteristics of the magnetron.

For example, if the height of the vane in the direction of the axis and the length of the input stem portion are decreased, cathode back heat by electrons or deterioration of load stability may occur. If the distance between both pole pieces is merely narrowed for the purpose of effective utilization of the magnet in order to reduce the height of the magnetron, electromagnetic coupling between the pole piece and the strap ring is increased and result in temperature rising of the cathode due to increase of cathode back heat by electrons. On the other hand, if the height of the vanes in the direction of the axis is shortened to assure the distance between the pole piece and the strap ring to some extent, load stability may be deteriorated. In addition, if the input stem portion is shortened, cathode back heat by electrons is extremely increased and temperature of the cathode is raised. In extreme cases, a part of the cathode may melt. Therefore, a magnetron which height of the vanes in the direction of the axis is 9 to 10 mm has ever been estimated suitable for miniaturization and favorable characteristics.

Japanese Patent Application Publication No. 1993-035531 gives attention especially to the distribution of magnetic field in the interaction space and discloses a magnetron that has smaller height of vanes in the direction of the axis by improving the shape, dimensions and electromagnetic coupling with the strap of the pole piece. According to this magnetron, change of the shape and the dimensions of pole piece makes that strength difference in the direction of the axis at the inner end surface of the vanes is less than a predetermined ratio, and equalizes distribution of the magnetic field in the interaction space. Furthermore, by digging the strap ring into inside the groove from the side end of the vane to decrease the electromagnetic coupling with the pole piece, cathode back heat by electrons and deterioration of the load stability rarely take place even if the height of the vanes in the direction of the axis or the input stem portion is diminished.

However, the magnetron disclosed in Japanese Patent Application Publication No. 1993-035531 has a vane of more than of equal to 8.5 mm in height in the direction of the axis. If the height of the vane in the direction of the axis is further decreased, it is conceivable that the load stability will be extremely deteriorated, so that the magnetron will not be suitable for practical use. Additionally, if the height of the vane in the direction of the axis is diminished, electrons leaking from the interaction space increase (i.e. dark current increases) because the gap between the end hats at the both ends of the cathode and the ends of the vane in the direction of the axis becomes large. Thus, there is a possibility of deterioration of the output efficiency and melting of the pole piece, etc.

The distance between the end hats at the both ends of the cathode, i.e. the effective length of the filament must be shortened in order to avoid deterioration of the output efficiency and melting of the vane, etc. However, if the effective length of the filament is shortened, the load stability will deteriorate further and the cathode back heat by electrons will increase.

BRIEF SUMMARY OF THE INVENTION

The present invention has been made to solve the above problems, and has an object to provide a smaller magnetron without deteriorating the characteristics such as the load stability.

According to an aspect of the present invention, there is provided A magnetron for microwave oven comprising: an anode cylinder extending cylindrically along a central axis; a plurality of vanes extending from an inner surface of the anode cylinder to the central axis and free ends thereof forming a vane inscribing circle; a spiral cathode extending spirally along at the central axis; a pair of end hats fixed to both ends of the cathode; and a pair of pole pieces located so as to pinch the cathode upon expanding like a funnel from a through-hole face to face with each end hat to an end of the anode cylinder, wherein $H \leqq 8.5$, $H/Da \leqq 0.95$, $DEH1/DPP1 \leqq 0.8$, $DEH1/DPP2 \leqq 0.8$, $DEH2/DPP1 \leqq 0.8$, $DEH2/DPP2 \leqq 0.8$, $0.92 \leqq Da/DPP1 \leqq 0.95$, and $0.92 \leqq Da/DPP2 \leqq 0.95$, where H (mm) is the height of the vane; Da (mm) is the diameter of the vane inscribing circle; DEH1 (mm) and DEH2 (mm) are outer diameters of the pair of end hats respectively; and DPP1 (mm) and DPP2 (mm) are inner diameters of the through-holes of the pair of pole pieces

BRIEF DESCRIPTION OF THE DRAWINGS

The above and other features and advantage of the present invention will become apparent from the discussion herein below of specific, illustrative embodiments thereof presented in conjunction with accompanying drawings, in which:

FIG. 3 is a table showing the shape and the characteristics of magnetrons for microwave oven.

DETAILED DESCRIPTION OF THE INVENTION

Hereinafter, embodiments of a magnetron for microwave oven according to the present invention will be described with reference to the drawings. The same symbols are given to same or similar configurations, and duplicated descriptions may be omitted.

Figure 2:
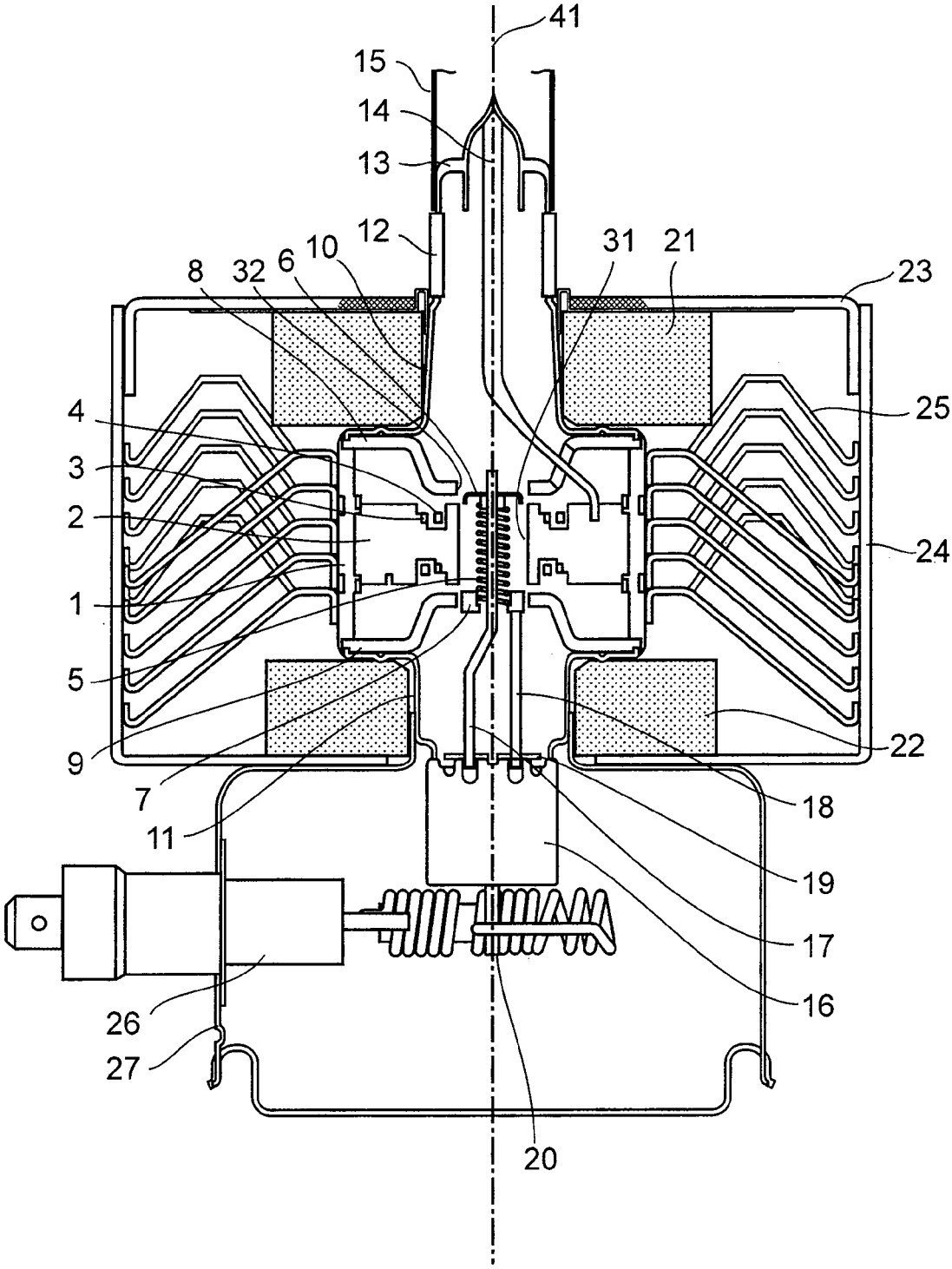
FIG. 2 is a cross sectional view of the magnetron for microwave oven according to an embodiment of the present invention.

FIG. 2 is a cross sectional view of the magnetron for microwave oven according to an embodiment of the present invention.

The magnetron for microwave oven of this embodiment has an anode cylinder 1, a cathode 5, a pair of end hats 6, 7, a pair of pole pieces 8, 9, which are located along the same axis (the central axis 41), and a plurality of vanes 2 extending radially from the proximity of the central axis 41.

The anode cylinder 1 extends cylindrically along the central axis 41. The vanes 2 extend radially from the proximity of the central axis 41, and fixed to the inner surface of the anode cylinder 1. Each of the vanes 2 is formed substantially as a rectangular plate. The free ends 31 of the vanes 2, which are not fixed to the inner surface of the anode cylinder 1, are arranged on a virtual cylindrical surface extending along the central axis 41, and the virtual cylindrical surface is denoted by 'the vane inscribing cylinder'. A plurality of vanes 2 are connected alternately in the circumferential direction by a pair of large and small strap rings 3, 4 soldered at the top and bottom ends of vanes.

The cathode 5 is spiral, located inside the vane inscribing cylinder which is an electronic interaction space, and located on the central axis of the anode cylinder 1. Both ends of the cathode 5 are fixed respectively to the end hats 6, 7. The end hats 6, 7 are located outside of the vanes 2 in the direction of the central axis 41 for example.

A pair of pole pieces 8, 9 are formed like funnels having a through-hole 32 at the center respectively. The center of the through-hole 32 is positioned on the central axis 41. Each of the pole pieces 8, 9 is formed as to expand from the through-hole 32 toward the outside of the space between the end hat 6 and the end hat 7 in the direction of the central axis 41. The pole pieces 8, 9 are formed as the outer diameter is as substantially same as the diameter of the anode cylinder 1. The outer peripheral portions of the pole pieces 8, 9 are fixed to each of the ends of the anode cylinder 1 respectively. Furthermore, the pair of the pole pieces 8, 9 are located on the both sides of the space between the end hats 6,7.

In addition, cylindrical metallic sealing members 10, 11 are fixed to the pole pieces 8, 9 respectively. Each metallic sealing member 10, 11 contacts with an end of the anode cylinder 1.

An output side ceramic 12 is bonded to the end metallic sealing member 10 of the output side at the end opposite to the pole piece 8. An exhausting pipe 13 is bonded to the end of the output side ceramic 12 at the end opposite to the metallic sealing member 10. An antenna 14 is led out from the vane 2. The antenna 14 passes through the pole piece 8 of the output side, and extends in the output portion. The tip of the antenna 14 is pinched and fixed by the exhausting pipe 13. The whole exhausting pipe 13 is covered with a cap 15.

An input side ceramic 16 is bonded to the metallic sealing member 11 of input side at the end opposite to the pole piece 9. Support rods 17, 18 are connected with the cathode 5 via the end hats 6, 7 respectively. The support rods 17, 18 are led out of the tube via an intermediate plate 19 for example and connected with an input terminal 20.

In addition, magnets 21, 22 and yokes 23, 24 surround the oscillating main body as described above to form a magnetic circuit. An outer package is constituted of a radiator 25 for cooling the oscillating main body, a filter 26 connected to the input side and a box 27 surrounding the filter 26.

Figure 1:
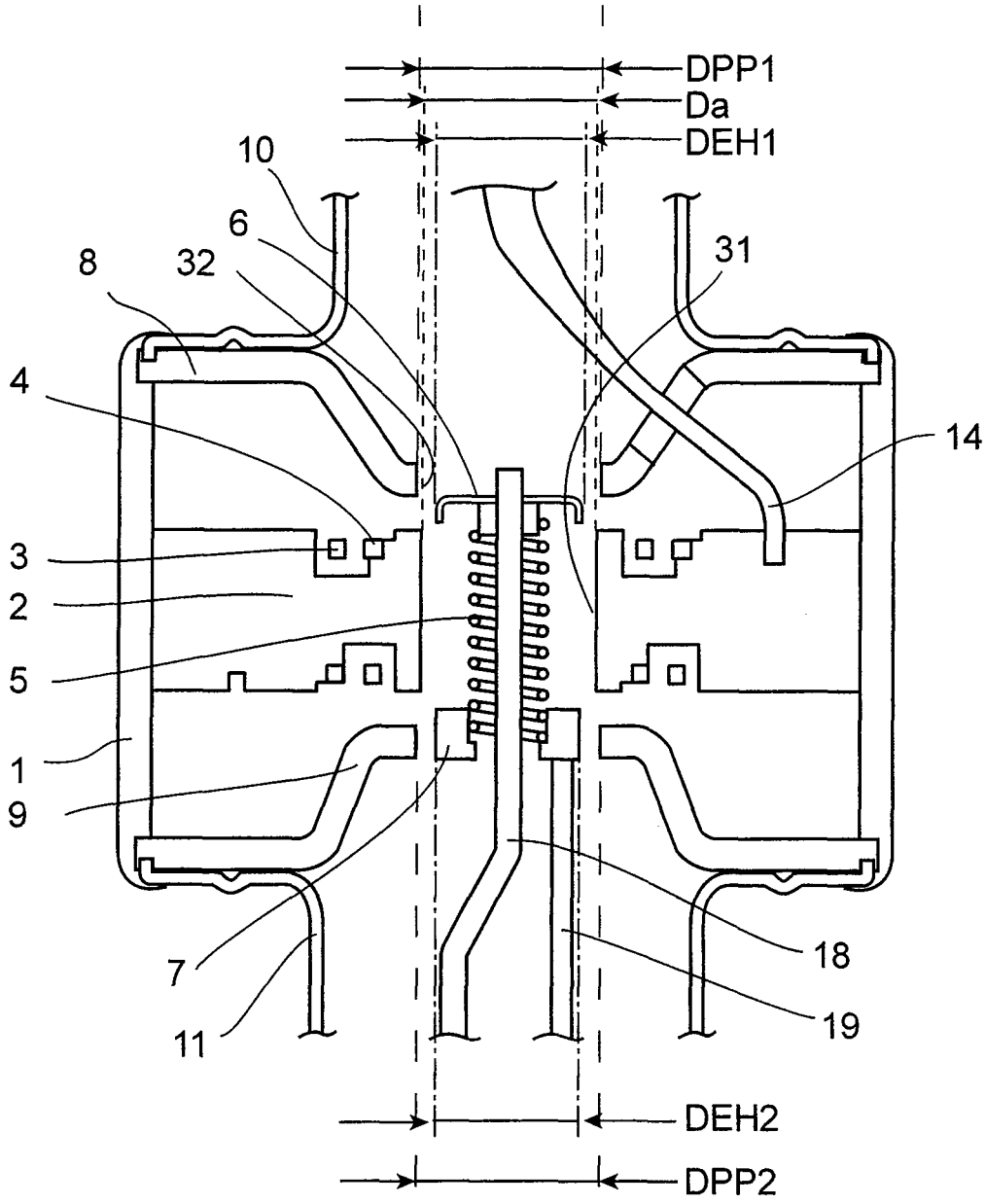
FIG. 1 is an enlarged cross sectional view around the anode cylinder of the magnetron for microwave oven according to an embodiment.

FIG. 1 is an enlarged cross sectional view around the anode cylinder of the magnetron for microwave oven according to this embodiment.

In the following explanation, the diameter and the height of the vane inscribing cylinder are denoted by Da and H respectively. The outer diameter of the end hat 6 of the output side is denoted by DEH1; the outer diameter of the end hat 7 of the input side is denoted by DEH2; the inner diameter of the pole piece 8 of the output side is denoted by DPP1; and the inner diameter of the pole piece 9 of the input side is denoted by DPP2. The input side means the side of support rods 17, 18 connected to the input terminal 20 and the output side means the opposite side to the input side. Hereinafter the end hat 6 and the pole piece 8 of the output side is also called as the upper end hat 6 and the upper pole piece 8 respectively. The end hat 7 and the pole piece 9 of the input side is also called as the lower end hat 7 and the lower pole piece 9 respectively.

In this embodiment, the height H of the vane 2 in the direction of the axis is 8.0 mm, the diameter Da of the vane inscribing circle is ϕ8.7 mm, the outer diameter DEH1 of the upper end hat 6 is ϕ7.2 mm, the outer diameter DEH2 of the lower end hat 7 is ϕ7.2 mm, the inner diameter DPP1 of the upper pole piece 8 is ϕ9.2 mm, and the inner diameter DPP2 of the lower pole piece 9 is ϕ9.4 mm. Additionally, corresponding to the shortened height H of the vane 2 in the direction of the axis, the distance between both end hats is 9.1 mm and the height of the pole pieces 8, 9 is 7.25 mm for example. The outer diameter of the cathode 5 is 3.9 mm.

FIG. 3 is a table showing the shape and the characteristics of magnetrons for microwave oven. The magnetron for microwave oven according to this embodiment is shown as No. 7. Moreover, characteristics of magnetrons for microwave oven having different dimensions are shown as well in this table. The height H of the vane 2 in the direction of the axis is 9.5 mm, which is larger than 8.5 mm, for the magnetrons having the shape represented as No. 1 to No. 3. No. 4 represents a magnetron having the substantially identical shape to the shape shown in the Patent Document 1, of which height H of the vane 2 in the direction of the axis is 8.5 mm.

For example, if the height of the vane in the direction of the axis is reduced by 1 mm from 9.5 mm to 8.5 mm for example, the thickness of the input side magnet can be reduced more. Hereinafter, the conditions of the shape of a magnetron of which height H of the vane 2 in the direction of the axis is less than or equal to 8.5 mm, to have characteristics equal or superior to the magnetrons of which H is more than 8.5 mm (No. 1 to No. 3), will be discussed.

The magnetron (No. 7) of this embodiment has the characteristics equal or superior to the characteristics of the magnetron (No. 1 to No. 3) of which height H of the vane 2 in the direction of the axis of 8.5 mm or more. The cathode back heat (90.5%) in this embodiment is smaller than the cathode back heat (91.2% or more) of the magnetron of which H is 9.5 mm, but is approximately the same.

On the other hand, the magnetron No. 4 of which height H of the vane 2 in the direction of the axis of 8.5 mm has the load stability of 1.62 A, which is smaller than the load stability (1.89 A or more) of the magnetron having the H of 9.5 mm, so the magnetron No. 4 does not have characteristics equal or superior to a magnetron of which H is more than 8.5 mm.

The magnetron No. 5 has the cathode back heat of 86.5%, which is smaller than the cathode back heat (91.2% or more) of the magnetron of which H is 9.5 mm. Furthermore, the load stability of the magnetron No. 5 is 1.74 A, which is smaller than the load stability (1.89 A or more) of the magnetron of which H of 9.5 mm, so the magnetron No. 5 does not have characteristics equal or superior to a magnetron having the H of more than 8.5 mm.

The magnetron No. 6 has the efficiency of 70.6%, which is smaller than the efficiency (71.0% or more) of the magnetron of which H of 9.5 mm, so the magnetron No. 6 does not have characteristics equal or superior to a magnetron having the H of more than 8.5 mm.

Therefore, the condition on which a magnetron has characteristics equal or superior to those of the magnetron of which height H of the vane 2 in the direction of the axis of 8.5 mm or more, includes the magnetron No. 7 and does not include the magnetrons No. 4, No. 5 and No. 6.

For miniaturizing a magnetron, it is desirable that the ratio (H/Da) of the height H of the vane 2 in the direction of the axis to the diameter Da of the vane inscribing circle is small. In addition, if the ratio of the diameter of the end hat to the inner diameter of the pole piece is too large, the cathode back heat gets worse. Consequently, the ratio (DEH/DPP) of the diameter of the end hat to the inner diameter of the pole piece must be smaller than a certain value. Experiments and experience clearly teaches that the magnetic flux introduced in the interaction space becomes small, and adverse effect on the load stability, on the dark current and on the efficiency appears if the ratio (Da/DPP) of the inner diameter of the pole piece to the diameter Da of the vane inscribing circle is too small or too large. Therefore, it is necessary that the ratio of the inner diameter of the pole piece to the diameter Da of the vane inscribing circle should be in a certain range.

Consequently, any magnetron of which H/Da, DEH/DPP and Da/DPP is in the certain ranges that includes the magnetron No. 7 and does not include the magnetrons No. 4, No. 5 and No. 6, has the characteristics equal or superior to the characteristics of the magnetron of which height H of the vane 2 in the direction of the axis of more than 8.5 mm. The table shown in FIG. 3 proves that the certain ranges are as follows.

$$H/Da \leqq 0.95 \quad (1)$$

$$DEH1/DPP1 \leqq 0.8 \quad (2)$$

$$DEH1/DPP2 \leqq 0.8 \quad (3)$$

$$DEH2/DPP1 \leqq 0.8 \quad (4)$$

$$DEH2/DPP2 \leqq 0.8 \quad (5)$$

$$0.92 \leqq Da/DPP1 \leqq 0.95 \quad (6)$$

$$0.92 \leqq Da/DPP2 \leqq 0.95 \quad (7)$$

That is to say, it is possible to provide a further miniaturized magnetron for microwave oven that has characteristics such as the load stability equal or superior to the magnetron of which height H of the vane in the direction of the axis of 8.5 mm by designing the shape and dimensions so as to satisfy the formula (1) to the formula (7). Particularly, the magnetron of which height of the vane in the direction of the axis is less than 8.5 mm, for example 8.4 mm or less and satisfying the formula (1) to the formula (7) has characteristics equal or superior to and is more miniaturized than the magnetron No. 4 of which height of the vane in the direction of the axis of 8.5 mm. Though the smaller height of the vane in the direction of the axis may deteriorate the characteristics, it is considered that at least a magnetron of which height of the vane in the direction of the axis is more than or equal to 5 mm have characteristics suitable for a microwave oven if the formula (1) to the formula (7) are satisfied. In addition, it is also considered that at least a magnetron of which height of the vane in the direction of the axis is more than or equal to 7 mm has the characteristics equal or superior to a magnetron of which height of the vane in the direction of the axis is more than 8.5 mm.

Power leakage of the magnetron No. 3 to the input side is 16.3 to 24.4 W/m$^2$, and power leakage of the magnetron No. 4 to the input side is 19.2 to 22.0 W/m$^2$. On the contrary, power leaking of the magnetron of this embodiment is 3.2 to 4.5 W/m$^2$, and it reveals that power leakage can be diminished to a large extent. Namely, in the magnetron of this embodiment, occurrence of accidents such as power leakage, when the choke coil connected to the input side is burned out or some problems take place in assembling the outer package, can be suppressed.

Furthermore, smaller ratio of the height H of the vane 2 in the direction of the axis to the diameter Da of the vane inscribing circle may cause, not only the decrease of the load stability and efficiency but also the increase of leakage of electrons from the interaction space. Therefore, the ratio (H/Da) is preferably in the following range.

$$0.8 \leqq H/Da \leqq 0.95 \quad (8)$$

If the ratio of the diameter of the end hat to the inner diameter of the pole piece is too small, dark current increases. Therefore, the ratio is preferably in the following range.

$$0.6 \leqq DEH1/DPP1 \leqq 0.8 \quad (9)$$

$$0.6 \leqq DEH1/DPP2 \leqq 0.8 \quad (10)$$

$$0.6 \leqq DEH2/DPP1 \leqq 0.8 \quad (11)$$

$$0.6 \leqq DEH2/DPP2 \leqq 0.8 \quad (12)$$

The explanation described above is merely an example, so that the present invention is not restricted to the embodiment mentioned above but various embodiments can be carried out.

What is claimed is:

1. A magnetron for microwave oven comprising:

an anode cylinder extending cylindrically along a central axis;

a plurality of vanes extending from an inner surface of the anode cylinder to the central axis and free ends thereof forming a vane inscribing circle;

a spiral cathode extending spirally along at the central axis;

a pair of end hats fixed to both ends of the cathode; and a pair of funnel-shaped pole pieces located so as to pinch the cathode upon expanding from a through-hole face to face with each end hat to an end of the anode cylinder, wherein H =8.0, H/Da<0.95, DEH1/DPP1<0.8, DEH1/DPP2<0.8, DEH2/DPP1<0.8, DEH2/DPP2<0.8, 0.92<Da/DPP1<0.95, and 0.92<Da/DPP2<0.95, where H (mm) is the height of the vane; Da (mm) is the diameter of the vane inscribing circle; DEH1 (mm) and DEH2 (mm) are outer diameters of the pair of end hats respectively; and DPP1 (mm) and DPP2 (mm) are inner diameters of the through-holes of the pair of pole pieces.

2. The magnetron of claim 1, wherein 0.8<H/Da, 0.6<DEH1/DPP1, 0.6<DEH1/DPP2, 0.6<DEH2/DPP1, and 0.6<DEH2/DPP2.

3. The magnetron of claim 1, wherein top surface of one of the end hats is located below a lowest edge of an upper one of the pole pieces.

4. The magnetron of claim 1, further comprising:

upper and lower end seals connected, respectively, to the pair of pole pieces; and an output side ceramic bonded to the upper end seal.

5. The magnetron of claim 4, further comprising:

an exhausting pipe bonded to the output side ceramic, wherein the exhausting pipe is arranged such that it pinches and fixes an antenna leading out from a vane.

6. A magnetron for microwave oven comprising:

an anode cylinder extending cylindrically along a central axis;

a plurality of vanes extending from an inner surface of the anode cylinder to the central axis and free ends thereof forming a vane inscribing circle;

a spiral cathode extending spirally along at the central axis;

a pair of end hats fixed to both ends of the cathode; and a pair of funnel-shaped pole pieces located so as to pinch the cathode upon expanding from a through-hole face to face with each end hat to an end of the anode cylinder, wherein H =8.0, H/Da<0.95, DEH1/DPP1<0.8, DEH1/DPP2<0.8, DEH2/DPP1<0.8, DEH2/DPP2<0.8, 0.92<Da/DPP1<0.95, and 0.92<Da/DPP2<0.95, where H (mm) is the height of the vane; Da (mm) is the diameter of the vane inscribing circle; DEH1 (mm) and DEH2 (mm) are outer diameters of the pair of end hats respectively; and DPP1 (mm) and DPP2 (mm) are inner diameters of the through-holes of the pair of pole pieces, wherein:

Da=8.7 mm;

DEH2=7.2 mm; and

DPP1=9.2 mm.

7. A magnetron for microwave oven comprising:

an anode cylinder extending cylindrically along a central axis;

a plurality of vanes extending from an inner surface of the anode cylinder to the central axis and free ends thereof forming a vane inscribing circle;

a spiral cathode extending spirally along at the central axis;

a pair of end hats fixed to both ends of the cathode; and a pair of funnel-shaped pole pieces located so as to pinch the cathode upon expanding from a through-hole face to face with each end hat to an end of the anode cylinder, wherein H <8.4, H/Da<0.95, DEH1/DPP1<0.8, DEH1/DPP2<0.8, DEH2 /DPP1<0.8, DEH2/DPP2<0.8, 0.92<Da/DPP1<0.95, and 0.92<Da/DPP2<0.95, where H (mm) is the height of the vane; Da (mm) is the diameter of the vane inscribing circle; DEH1 (mm) and DEH2 (mm) are outer diameters of the pair of end hats respectively; and DPP1 (mm) and DPP2 (mm) are inner diameters of the through-holes of the pair of pole pieces, and wherein DPP1 and DPP2 differ by at least 0.2 (mm).

8. The magnetron of claim 7, wherein DPP1 is on an output side of the magnetron, DPP2 is on an input side of the magnetron, and DPP2>DPP1.

9. The magnetron of claim 8, wherein DPP1 exceeds Da by at least 0.7 (mm).

10. The magnetron of claim 7, wherein DEH1=DEH2, and wherein DPP1 is on an output side of the magnetron, DPP2 is on an input side of the magnetron, DPP1=9.2 (mm) and DPP2=9.4 (mm).

* * * * *

UNITED STATES PATENT AND TRADEMARK OFFICE

CERTIFICATE OF CORRECTION

PATENT NO. : 8,525,413 B2
APPLICATION NO. : 12/208760
DATED : September 3, 2013
INVENTOR(S) : Masatoshi Higashi It is certified that error appears in the above-identified patent and that said Letters Patent is hereby corrected as shown below:

In the claims,

In Column 6, Claim 1, Lines 50-52:

Please delete "H/Da<0.95, DEH1/DPP1<0.8, DEH1/DPP2<0.8, DEH2/DPP1<0.8, DEH2/DPP2<0.8, 0.92<Da/DPP1<0.95, and 0.92<Da/DPP2<0.95," and replace with --H/Da≤0.95, DEH1/DPP1≤0.8, DEH1/DPP2≤0.8, DEH2/DPP1≤0.8, DEH2/DPP2≤0.8, 0.92≤Da/DPP1≤0.95, and 0.92≤Da/DPP2≤0.95,--

In Column 6, Claim 2, Lines 58-60:

Please delete "0.8<H/Da, 0.6<DEH1/DPP1, 0.6<DEH1/DPP2, 0.6<DEH2/DPP1, and 0.6<DEH2/DPP2." and replace with --0.8≤H/Da, 0.6≤DEH1/DPP1, 0.6≤DEH1/DPP2, 0.6≤DEH2/DPP1, and 0.6≤DEH2/DPP2.--

In Column 7, Claim 6, Lines 16-18:

Please delete "H/Da<0.95, DEH1/DPP1<0.8, DEH1/DPP2<0.8, DEH2/DPP1<0.8, DEH2/DPP2<0.8, 0.92<Da/DPP1<0.95, and 0.92<Da/DPP2<0.95," and replace with --H/Da≤0.95, DEH1/DPP1≤0.8, DEH1/DPP2≤0.8, DEH2/DPP1≤0.8, DEH2/DPP2≤0.8, 0.92≤Da/DPP1≤0.95, and 0.92≤Da/DPP2≤0.95,--

In Column 8, Claim 7, Lines 12-14:

Please delete "H<8.4, H/Da<0.95, DEH1/DPP1<0.8, DEH1/DPP2<0.8, DEH2/DPP1<0.8, DEH2/DPP2<0.8, 0.92<Da/DPP1<0.95, and 0.92<Da/DPP2<0.95," and replace with --H≤8.4, H/Da≤0.95, DEH1/DPP1≤0.8, DEH1/DPP2≤0.8, DEH2/DPP1≤0.8, DEH2/DPP2≤0.8, 0.92≤Da/DPP1≤0.95, 0.92≤Da/DPP2≤0.95,--

Signed and Sealed this
Eighth Day of December, 2015

Michelle K. Lee

Michelle K. Lee
*Director of the United States Patent and Trademark Office*